US010293395B2

(12) United States Patent
Bargna et al.

(10) Patent No.: US 10,293,395 B2
(45) Date of Patent: May 21, 2019

(54) MACHINE FOR BENDING A THREAD-LIKE MATERIAL SUCH AS A PIPE BY WAY OF A SYSTEM FOR SIMULTANEOUSLY LOADING A PIPE TO BE BENT AND UNLOADING A BENT PIPE

(71) Applicant: CRIPPA S.p.A., Arosio (CO) (IT)

(72) Inventors: Claudio Bargna, Arosio (IT); Domenico Fulco, Arosio (IT)

(73) Assignee: CRIPPA S.p.A., Arosio (CO) (IT)

( * ) Notice: Subject to any disclaimer, the term of this patent is extended or adjusted under 35 U.S.C. 154(b) by 0 days.

(21) Appl. No.: 15/821,235

(22) Filed: Nov. 22, 2017

(65) Prior Publication Data

US 2018/0147615 A1 May 31, 2018

(30) Foreign Application Priority Data

Nov. 25, 2016 (IT) ..... 102016000119591

(51) Int. Cl.

| | |
|---|---|
| ***B21D 7/04*** | (2006.01) |
| ***B21D 7/03*** | (2006.01) |
| ***B21D 7/022*** | (2006.01) |
| ***B21D 43/00*** | (2006.01) |
| ***B21D 7/024*** | (2006.01) |

(52) U.S. Cl.

CPC ..... *B21D 7/03* (2013.01); *B21D 7/022* (2013.01); *B21D 7/024* (2013.01); *B21D 7/04* (2013.01); *B21D 43/006* (2013.01)

(58) Field of Classification Search

CPC ..... B21D 11/12; B21D 7/024; B21D 7/08; B21D 7/02; B21D 7/022; B21D 7/06; B21D 7/03

USPC ..... 72/428

See application file for complete search history.

(56) References Cited

U.S. PATENT DOCUMENTS

| | | | | | |
|---|---|---|---|---|---|
| 3,017,914 | A * | 1/1962 | Fuchs, Jr. | B21D 9/03 | 72/298 |
| 3,426,562 | A * | 2/1969 | Floyd | B21D 7/06 | 72/14.8 |
| 3,808,856 | A * | 5/1974 | Lance | B21D 7/024 | 72/14.8 |
| 4,078,411 | A * | 3/1978 | Eaton | B21D 7/024 | 72/154 |
| 4,178,788 | A * | 12/1979 | Zollweg | B21D 7/024 | 72/154 |
| 4,662,204 | A * | 5/1987 | Saegusa | B21D 7/022 | 269/234 |
| 4,782,684 | A * | 11/1988 | Benton | B21D 7/02 | 137/580 |
| 4,848,120 | A * | 7/1989 | Schwarze | B21D 7/16 | 72/149 |
| 4,945,747 | A * | 8/1990 | Yogo | B21D 7/022 | 72/217 |
| 5,426,965 | A * | 6/1995 | Hopf | B21D 7/024 | 72/149 |

(Continued)

*Primary Examiner* — David B Jones

(74) *Attorney, Agent, or Firm* — Greer Burns & Crain, Ltd.

(57) ABSTRACT

A machine for bending a thread-like material such as a pipe, a section iron, a bar, or the like, briefly a "pipe", provided with a system for simultaneously loading a pipe to be bent and unloading another, already bent pipe, comprising a vertical hinge provided with a bending head provided with a motor for driving the bending head into rotation about an axis orthogonal to the hinge.

11 Claims, 2 Drawing Sheets

(56) References Cited

U.S. PATENT DOCUMENTS

| | | | | |
|---|---|---|---|---|
| 5,765,426 | A * | 6/1998 | Saegusa | B21D 7/08 72/217 |
| 7,104,100 | B2 * | 9/2006 | Saegusa | B21D 7/024 72/149 |
| 2015/0040634 | A1 * | 2/2015 | Costet | B21D 11/12 72/159 |

* cited by examiner

MACHINE FOR BENDING A THREAD-LIKE MATERIAL SUCH AS A PIPE BY WAY OF A SYSTEM FOR SIMULTANEOUSLY LOADING A PIPE TO BE BENT AND UNLOADING A BENT PIPE

OBJECT OF THE INVENTION

The object of the present invention is a machine for bending a thread-like material such as a pipe, a section iron, a bar, or the like, briefly a "pipe", equipped with a system allowing to simultaneously load a pipe to be bent and to unload another, already bent pipe.

PRESENT STATUS OF THE ART

The known machines used for bending a thread-like material such as a pipe, a section iron, a bar, or the like, all together briefly referred to in this document and in the attached claims as "pipe", feature a production cycle which can be described as follows.

The pipes to be bent are positioned on a plane, often an inclined plane. A pipe to be bent is loaded on the pipe bending machine by way of means that pick-up the pipe from the plane and position it on the machine.

The pipe picked-up from the plane is processed and unloaded at the end of the production cycle.

Once the bent pipe is unloaded, the process starts from the beginning with another production cycle.

The most recent industrial processes require production cycles featuring reduced times for the pipe bending machines. In order to reduce such times, the known machines shall increase the speed of every cycle, by disadvantageously using much energy and high-power motors.

DISCLOSURE OF THE INVENTION

In order to obviate the mentioned drawbacks, the present invention reduces the times of every production cycle as compared to those of the prior art machines, by loading a pipe to be bent on the machine and simultaneously unloading another, already bent pipe.

In order to have pipes simultaneously loaded and unloaded, the machine according to the present invention comprises a hinge connected to one end of the bed present in all pipe bending machines. Said hinge is provided with or joined to a bending head which is a unidirectional, bidirectional, or double headed one, alternatively. The hinge is also provided with a loading arm complete with clamping tools, connected to means suitable for moving the loading arm and the clamping tools on the basis of a program predetermined by the machine manufacturer or by the user himself.

The hinge is a vertical hinge provided with first means for moving, preferably flag-moving, about at least one pivot. Said first hinge moving means are suitable for moving it while keeping it in a position that is orthogonal or substantially orthogonal to the plane on which the machine is located.

Thanks to the flag-movement of the hinge, the first hinge moving means activates the hinge so that the loading arm is shifted to a position close to a plane on which the pipes to be bent are located. A pipe thereof can thus be picked-up by the clamping tools which the loading arm is provided with thanks to means that control the movements of the loading arm and the clamping means present in said loading arm, such procedure will be briefly referred to below as "pipe loading".

Once the pipe to be bent is picked-up, the first hinge moving means displace the picked-up pipe on the basis of the flag-movement of the hinge from the mentioned plane to a position suitable for the insertion of the pipe to be bent in the bending head in order for it to be bent.

The bending head is also provided with a motor for driving the bending head into rotation about an axis orthogonal with respect to the hinge. Such rotation makes it possible to rotate the head so as to unload the pipe, once it is bent. Such unloading advantageously takes place in the same moment as the "pipe loading" one described above, thus shortening every production cycle.

In order to illustrate the machine according to the present invention more exhaustively, and in particular the simultaneous loading of a pipe to be bent and unloading of another, already bent pipe, it is worth illustrating the movement of the above-mentioned components which are the subject of the present invention in one embodiment.

The movements of said components are illustrated from the point of view of one placed in front of the machine according to the present invention, beyond the bending head, starting from the machine being stationary.

The hinge, by flag-moving thanks to the first hinge moving means, moves to the right and displaces the loading arm which the hinge is provided with, thus getting closer to a plane on which there are located the pipes to be bent. A pipe thereof can thus be picked-up by the clamping tools which the loading arm is provided with, thanks to the means controlling the movements of the loading arm and the clamping ones. This procedure is briefly referred to as "pipe loading", as already stated above. At the same time when the pipe to be bent is loaded, the bending head, in which another, already bent pipe is present, rotates counterclockwise about an axis orthogonal to the hinge and unloads the bent pipe.

For a better synchronization of the pipe loading and unloading operations, the machine according to the present invention comprises second synchronization means for synchronizing the hinge moving means with the motor used to rotate the bending head.

In one embodiment, the machine according to the present invention comprises a hinge provided with second means for moving the bending head in a vertical direction and/or third means for moving the bending head in a horizontal direction. Said second and third bending head moving means are equipped in order to make the insertion of the pipe to be bent in the bending head easier and faster. Such second and third means are preferably formed of one or more guides.

The pipe bending machine according to the present invention thus comprises a hinge provided with or joined to a bending head which is a unidirectional, bidirectional, or double-headed one, alternatively. Said hinge is provided with a loading arm provided with clamping tools and is a vertical hinge provided with first moving means for moving the hinge about at least one pivot.

The mentioned bending head is provided with a motor for driving the bending head into rotation about an axis orthogonal to the hinge.

The machine according to the present invention also comprises synchronization means for synchronizing the first hinge (1) moving means with the motor used to drive the bending head into rotation for simultaneously loading a pipe to be bent and unloading another, already bent pipe.

In one embodiment, the hinge is provided with second means for moving the bending head in a vertical direction and/or third means for moving the bending head in a horizontal direction.

The second and third means are preferably formed of one or more guides.

DESCRIPTION OF THE FIGURES

FIG. 1 shows a machine for bending a thread-like material such as a pipe, a bar, or section iron according to the present invention, which comprises a hinge (1). Said hinge (1) is provided with a bending head (2). Such bending head can be a unidirectional, bidirectional, or double-headed one, alternatively. In the case of FIG. 1, the type of the bending head is not shown. The hinge (1) is provided with a loading arm (3) complete with clamping tools ($\mathbf{3}^1$).

The hinge (1) is a vertical hinge provided with first means, not shown in the figures, for moving the hinge (1) about at least one pivot ($\mathbf{1}^1$). FIG. 1 also shows the bending head (2) provided with a motor (5) for driving the bending head (2) into rotation about an axis (A) orthogonal to the hinge (1). In order to synchronize the first means used to move the hinge (1) with the motor (5) for driving the bending head (2) into rotation, a synchronization means, not shown in the figures, is provided.

The hinge (1) is provided with second means (6) for moving the bending head (2) in a vertical direction and FIG. 1 shows two guides ($\mathbf{6}^1$) which are a preferred embodiment of the moving means (6).

The hinge (1) is also provided with third means for moving the bending head (2) in a horizontal direction, preferably complete with one or more guides. The moving means and the one or more guides are not shown in the figures.

Figure 1:
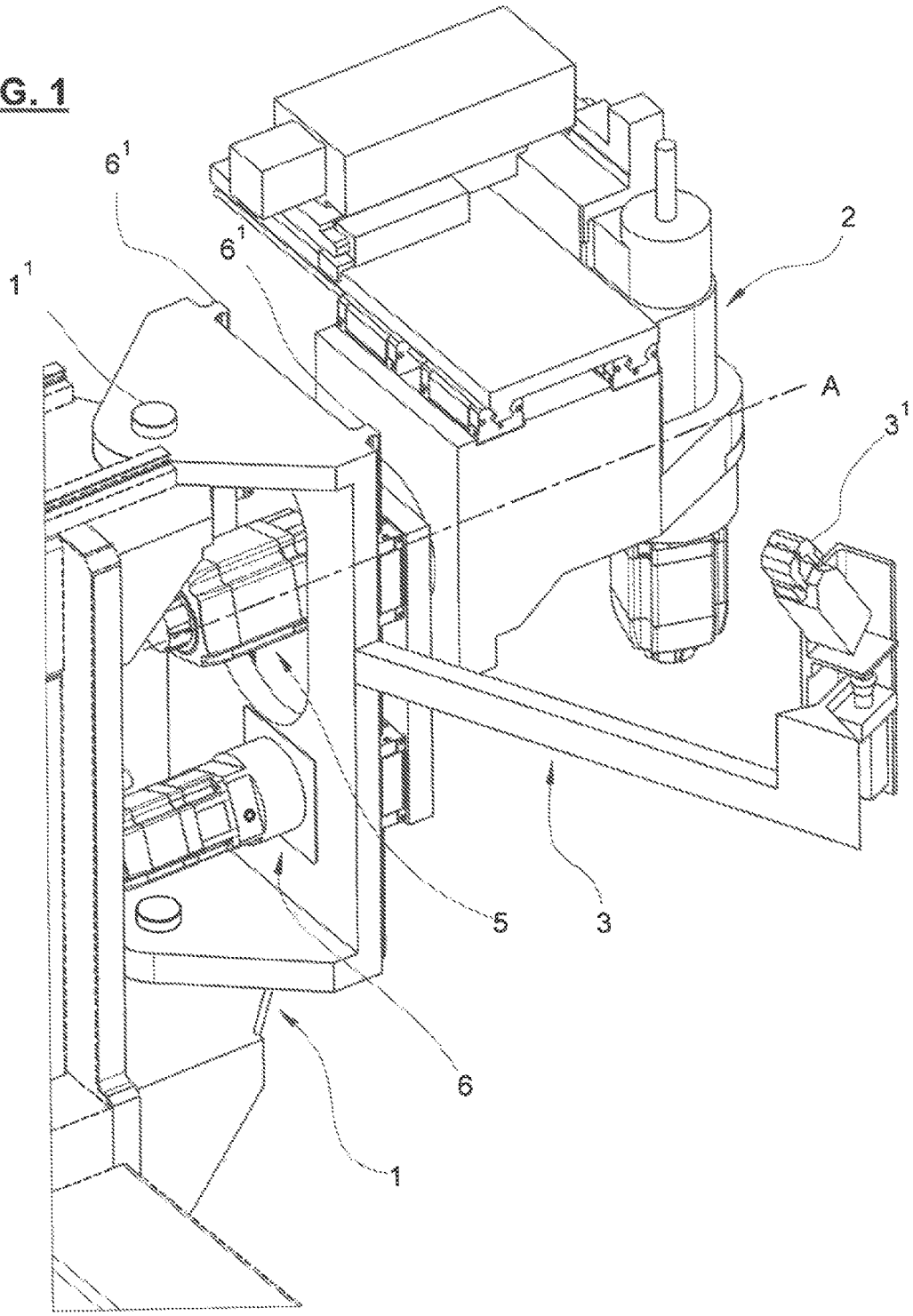
FIG. 1 is a three-dimensional representation of the machine according to the present invention in its idle status.
Figure 2:
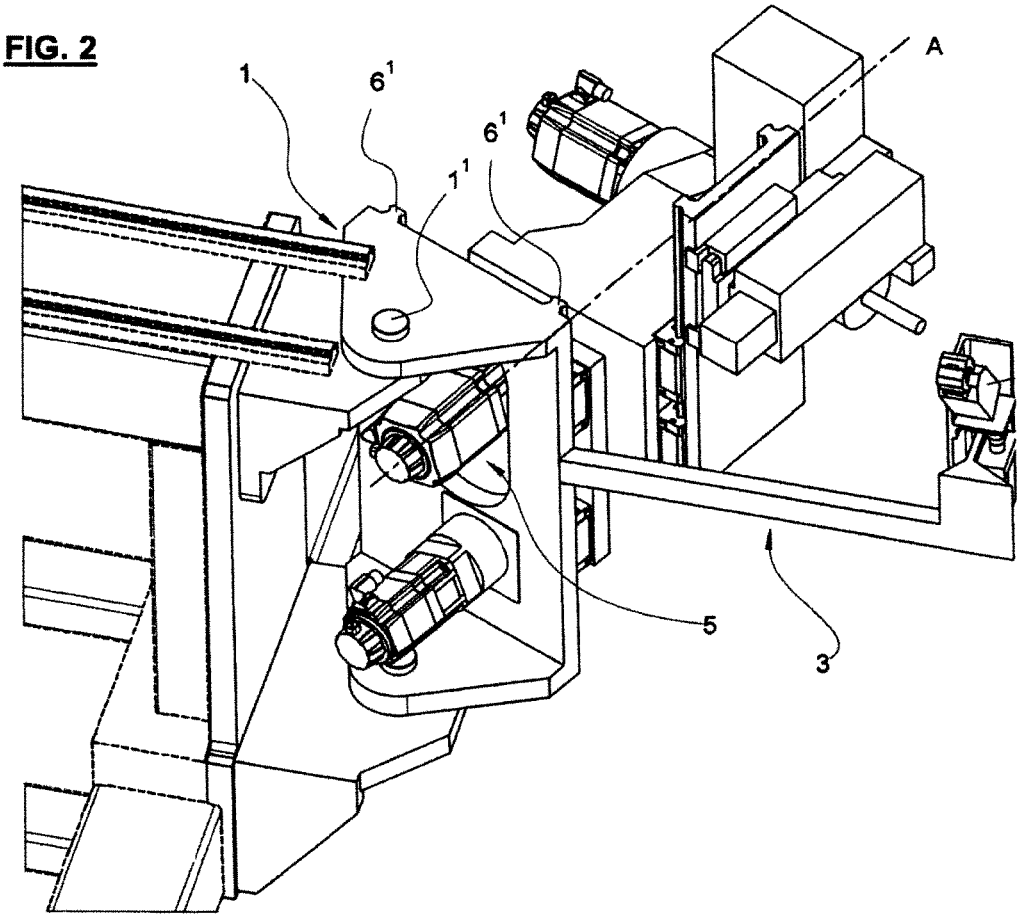
FIG. 2 shows a graphical three-dimensional representation of the machine according to the present invention while a pipe to be bent is loaded and simultaneously another, already bent pipe is unloaded.

FIG. 2 shows the hinge (1) rotated about the pivot ($\mathbf{1}^1$) for making it possible for the clamping means ($\mathbf{3}^1$) of the loading arm (3) to load a pipe to be bent and the bending head (2) driven into rotation about the axis "A" by the motor (5) to unload another, already bent pipe. Such loading and unloading operations take place simultaneously thanks to the synchronization means, which synchronize the first hinge (1) moving means not shown in the figures, with the motor (5).

The invention claimed is:

1. A machine for bending a thread-like material comprising:

a hinge provided with a bending head, wherein said hinge is rotatable about at least one pivot, and a loading arm provided with clamping tools, wherein said clamping tools include a pair of closable clamping claws for picking-up the thread-like material, and wherein said loading arm is fixed with respect to said hinge for movement about said at least one pivot, and wherein the bending head is provided with a motor for driving the bending head.

2. The machine according to claim 1, wherein the hinge is a vertical hinge that moves about said at least one pivot.

3. The machine according to claim 1, wherein said motor drives the bending head into rotation about an axis (A) orthogonal to the hinge.

4. The machine according to claim 3, wherein said machine comprises means (S) for synchronizing the movement of the hinge with the motor used to drive the bending head into rotation.

5. The machine according to claim 4, wherein the hinge is provided with a means for moving the bending head vertically.

6. The machine according to claim 4, wherein the hinge moves the bending head horizontally.

7. The machine according to claim 5, wherein said means for moving the head vertically comprises at least one elongated guide.

8. The machine according to claim 7, wherein at least one elongated guide is provided for moving the head vertically.

9. The machine according to claim 1, wherein the thread-like material comprises a pipe.

10. The machine according to claim 1, wherein:

said at least one pivot defines a first axis extending vertically; and said bending head rotates about a second axis, wherein said second axis is orthogonal to said first axis.

11. The machine according to claim 2, wherein said bending head is joined to said hinge such that when said hinge moves about said at least one pivot, said bending head also correspondingly moves about said at least one pivot.

* * * * *